US007471279B2

(12) United States Patent
Chiu et al.

(10) Patent No.: US 7,471,279 B2
(45) Date of Patent: Dec. 30, 2008

(54) DISPLAY CIRCUIT AND DISPLAY METHOD

(75) Inventors: Chaung-Ming Chiu, Jungli (TW); Geng Lin, Sinshih Township, Tainan County (TW)

(73) Assignee: TPO Displays Corp., Miao-Li County (TW)

( * ) Notice: Subject to any disclaimer, the term of this patent is extended or adjusted under 35 U.S.C. 154(b) by 535 days.

(21) Appl. No.: 11/037,052

(22) Filed: Jan. 19, 2005

(65) Prior Publication Data

US 2005/0225526 A1 Oct. 13, 2005

(30) Foreign Application Priority Data

Apr. 8, 2004 (TW) ..... 93109689 A

(51) Int. Cl.
*G09G 3/36* (2006.01)

(52) U.S. Cl. ..... 345/100; 345/87; 345/98

(58) Field of Classification Search ..... 345/100, 345/55, 84, 87, 90, 92, 98, 204, 690, 694
See application file for complete search history.

(56) References Cited

U.S. PATENT DOCUMENTS 5,598,178 A * 1/1997 Kawamori ..... 345/93
6,791,539 B2 * 9/2004 Nakajima et al. ..... 345/204
6,958,745 B2 * 10/2005 Murase et al. ..... 345/100
7,079,122 B2 * 7/2006 Morita ..... 345/204
7,091,946 B2 * 8/2006 Tsutsui et al. ..... 345/100
7,123,247 B2 * 10/2006 Morita ..... 345/204
7,327,341 B2 * 2/2008 Toriumi et al. ..... 345/98
2001/0052887 A1 * 12/2001 Tsutsui et al. ..... 345/87
2002/0097208 A1 * 7/2002 Hashimoto ..... 345/87
2002/0126107 A1 * 9/2002 Inoue et al. ..... 345/204
2002/0175887 A1 * 11/2002 Yamazaki ..... 345/87

FOREIGN PATENT DOCUMENTS

CN 1455383 A 11/2003

* cited by examiner

*Primary Examiner*—My-Chau T Tran
(74) *Attorney, Agent, or Firm*—MH2 Technology Law Group LLP

(57) ABSTRACT

A display circuit for a liquid crystal display panel is provided. The display circuit comprises a control circuit, a data driving circuit, a partial display mode driving circuit, a scanning circuit, and a liquid crystal display panel. When the LCD works in the partial display mode, the control circuit will stop sending out the shift clock signal for controlling the data driving circuit for the non-display area and will make both ends of the pixel electrodes in the non-display area equipotential. Hence, there is no complicated operation for the data driving circuit, and power consumption and thus be reduced.

11 Claims, 7 Drawing Sheets

DISPLAY CIRCUIT AND DISPLAY METHOD

CROSS-REFERENCE TO RELATED APPLICATION

This application claims the priority benefit of Taiwan application serial no. 93109689, filed on Apr. 8, 2004.

BACKGROUND OF THE INVENTION

1. Field of the Invention

This invention generally relates to a display circuit, and more particularly to a display circuit and a display method.

2. Description of Related Art

The liquid crystal display (LCD) was applied to the electronic calculator and the electronic watch. Improvements in optoelectronics effect and driving technology have led the LCD to possess the advantages of low power consumption, light weight, and low voltage driving, and to be widely used in TV sets, mobile phones, laptop computers, personal digital assistants (PDAs), etc. The LCD display industry has been recognized to be one of the most thriving industries.

FIG. 1 shows the partial display mode of an LCD panel. Referring to FIG. 1, in the LCD, there is a display mode called the partial display mode. When the LCD works in the partial display mode, display area and non-display area are displayed on the screen. Only the display area will display the image; the non-display area will not display any image.

FIG. 2A is the internal circuit of a conventional LCD. Referring to FIG. 2A, a conventional LCD internal circuit includes a control circuit 210, a scanning driving circuit 220, a data driving circuit 230, and an LCD panel 240. A shift clock signal terminal 211 and a data signal terminal 212 of control circuit 210 are respectively coupled to data driving circuit 230. The n data lines ($Y_1$-$Y_n$) of the data driving circuit 230 and the m scan lines ($X_1$-$X_m$) of the scanning driving circuit 220 are coupled to the LCD panel 240. The data driving circuit 230 includes the shift register set 231 and n transmission gates 232. Each transmission gate 232 has a first triggering terminal 21 and a second triggering terminal 23 coupled to the shift register set 231. A data signal input terminal 25 of each transmission gate 232 is coupled to the data signal terminal 212 and a data signal output terminal 27 of each transmission gate 232 is coupled to a data line, for example, data line $Y_3$. The shift register set is coupled to the shift clock signal terminal 211 and turns on the transmission gates 232 based on the shift clock signal Vshift.

FIG. 2B is another data driving circuit of a conventional LCD. Referring to FIG. 2B, the data driving circuit 230 uses transistor switches 234 to replace the transmission gates 232 described with respect to FIG. 2A. In FIG. 2B, one source/drain of each transistor 234 is coupled to the shift register set 231, and the other source/drain of each transistor 234 is coupled to a data line, for example, data line $Y_3$. Each transmission gate 232 is coupled to the data signal terminal 212.

The operation principles of the data driving circuit 230 in FIGS. 2A and 2B are the same. The following description is based on the data driving circuit in FIG. 2A. Referring to FIG. 2A, for simplicity, only one pixel circuit 250 is taken as an example for illustration. Pixel circuit 250 includes a thin film transistor (TFT) 251, a capacitor 252, and a pixel electrode 255. The traditional display circuit of the LCD operates in the same way regardless of full display mode or partial display mode. When displaying the image, scanning driving circuit 220 will turn on TFT 251. At the same time, control circuit 210 will send the shift clock signal Vshift and the data signal Vdata. Shift register set 231 decides when to turn on transmission gate 232 is on, the data signal Vdata will be sent to TFT 251. When TFT 251 is on, the data signal Vdata will charge capacitor 252 so that capacitor 252 can make pixel electrode 255 display on the screen.

In the partial display mode, although LCD panel 240 is black at the non-display area, shift register set 231 still has to send the data signal to LCD panel 240. That is, all circuits work in the same way whether they are for the display area or the non-display area. Such structure is simple, but would consume unnecessary power.

SUMMARY OF THE INVENTION

The present invention is directed to a display circuit and method for a display. When the LCD works in a partial display mode, the shift register set is not operational for the non-display area in order to reduce power consumption.

The present invention is directed to a display circuit for a liquid crystal display panel. According to an embodiment of the present invention, the display circuit comprises a data driving circuit having a plurality of data lines coupled to the liquid crystal display panel, a partial display mode driving circuit having a plurality of common voltage output terminals corresponding and being coupled to the plurality of data lines, and a control circuit coupled to the data driving circuit and the partial display mode driving circuit. When the liquid crystal display panel is scanned to a display area, the data driving circuit sends out a data signal to the liquid crystal display panel via one of the plurality of data lines based on a shift clock signal. When the liquid crystal display panel is scanned to a non-display area, the partial display mode driving circuit receives a partial display mode signal and sends a common voltage to the liquid crystal display panel via the plurality of data lines. When the liquid crystal display panel is scanned to the non-display area, the control circuit sends the shift clock signal to the data driving circuit and the partial display mode signal to the partial display mode driving circuit, and the control circuit stops sending out the shift clock signal and starts sending out the partial display mode signal to enable the partial display mode driving circuit.

In an embodiment of the present invention, the partial display mode driving circuit comprises a plurality of switches respectively coupled to one of the plurality of data lines, and the partial display mode signal determines whether or not to turn on the plurality of switches.

In an embodiment of the present invention, each of the plurality of switches of the partial display mode driving circuit includes a MOS transistor having a gate, a first source/drain, and a second source/drain. The gate is coupled to the control circuit for receiving the partial display mode signal to determine whether or not to turn on the transistor, the first source/drain receives the common voltage, and the second source/drain is coupled to one of the plurality of data lines.

In an embodiment of the present invention, each of the plurality of switches of the partial display mode driving circuit includes a transmission gate having a first triggering terminal, a second triggering terminal, a common voltage input terminal, and a common voltage output terminal. The first triggering terminal and the second triggering terminal are coupled to the control circuit for receiving the partial display mode signal to determine whether or not to turn on the transmission gate. The common voltage input terminal receives the common voltage, and the common voltage output terminal is coupled to one of the plurality of data lines.

According to an embodiment of the present invention, the display circuit comprises a data driving circuit having a plurality of data lines coupled to the liquid crystal display panel, a partial display mode driving circuit having a plurality of switches, and a control circuit coupled to the data driving circuit. When the liquid crystal display panel is scanned to a display area, the data driving circuit sends out a data signal to the liquid crystal display panel via one of the plurality of data lines based on a shift clock signal. The partial display mode signal determines whether or not to turn on the plurality of switches. When the liquid crystal display panel is scanned to a non-display area, the partial display mode signal turns on a portion of the plurality of switches corresponding to a portion of the data lines in the non-display area. When the liquid crystal display panel is scanned to a display area, the control circuit sends out the shift clock signal to the data driving circuit, and when the liquid crystal display panel is scanned to the non-display area, the control circuit stopping sends out the shift clock signal.

In an embodiment of the present invention, each of the plurality of switches includes a MOS transistor having a gate receiving the partial display mode signal.

In an embodiment of the present invention, the display circuit further comprises a plurality of pixel circuits arranged in an array manner on the liquid crystal display panel, and each of the plurality of pixel circuits includes a pixel electrode.

In an embodiment of the present invention, both ends of each of the pixel electrode are respectively coupled to two sources/drains of one of the plurality of MOS transistors.

In an embodiment of the present invention, both ends of a portion of the pixel electrode are respectively coupled to two sources/drains of one of the plurality of MOS transistors.

According to various aspects of the invention, a display method for a display having a plurality of pixel electrodes and a plurality of data lines is provided. The display may include a data driving circuit controlled by a shift clock signal. In the method, according to an embodiment of the present invention, it is determined whether the pixel electrodes are in a display area, and both ends of the plurality of pixel electrodes are rendered equipotential when the pixel electrodes are not in the display area.

In an embodiment of the present invention, making both ends of the plurality of pixel electrodes equipotential is accomplished by, for example, stopping sending of the shift clock signal to the data driving circuit and sending a common voltage via the plurality of data lines to the plurality of pixel electrodes.

In an embodiment of the present invention, making both ends of the plurality of pixel electrodes equipotential is accomplished by, for example, stopping sending of the shift clock signal to the data driving circuit and sending a partial display mode signal to short-circuit both ends of the plurality of pixel electrodes. In this embodiment, the partial display mode signal may be used to determine whether or not to turn on the transistor switch. When the switch is on, both ends of the plurality of pixel electrodes are completely short-circuited because there is still a minimal voltage drop at both ends of the plurality of pixel electrodes. That is why both ends of the plurality of pixel electrodes are substantially short-circuited.

In light of the above, when the LCD works in the partial display mode, the control circuit will stop sending out the shift clock signal for controlling the data driving circuit for the non-display area and will make both ends of the pixel electrode equipotential. Hence, the operation for data driving circuit is not complicated and thus can reduce power consumption.

The above is a brief description of some deficiencies in the prior art and advantages of the present invention. Other features, advantages and embodiments of the invention will be apparent to those skilled in the art from the following description, accompanying drawings and appended claims.

DESCRIPTION OF THE EMBODIMENTS

Figure 1:
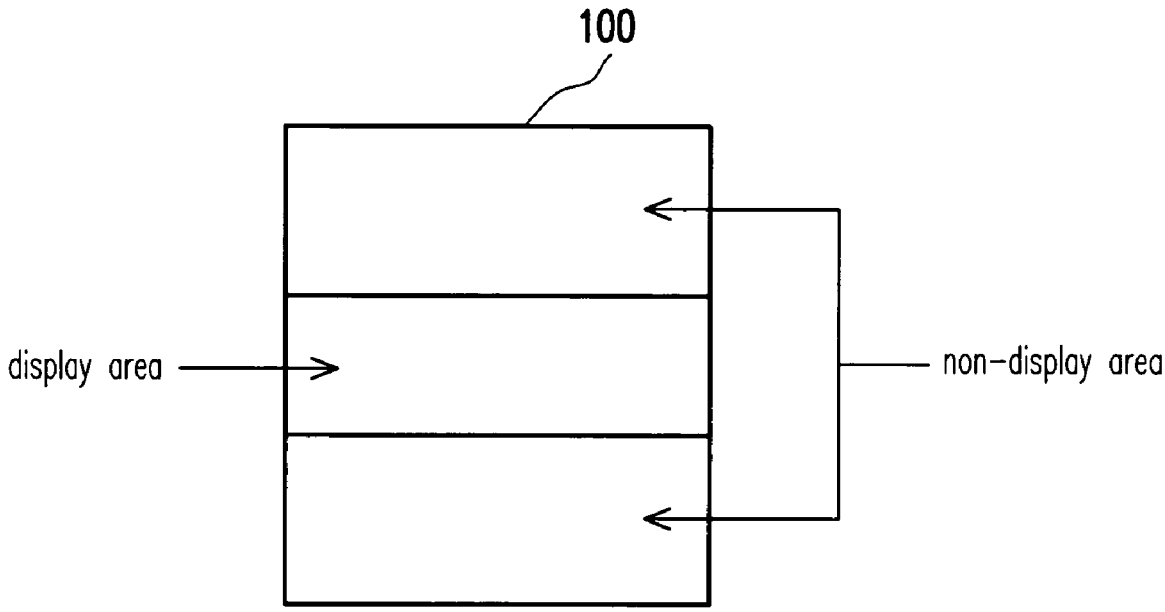
FIG. 1 (Related Art)
FIG. 1 shows the partial display mode of a conventional LCD panel.
Figure 2A:
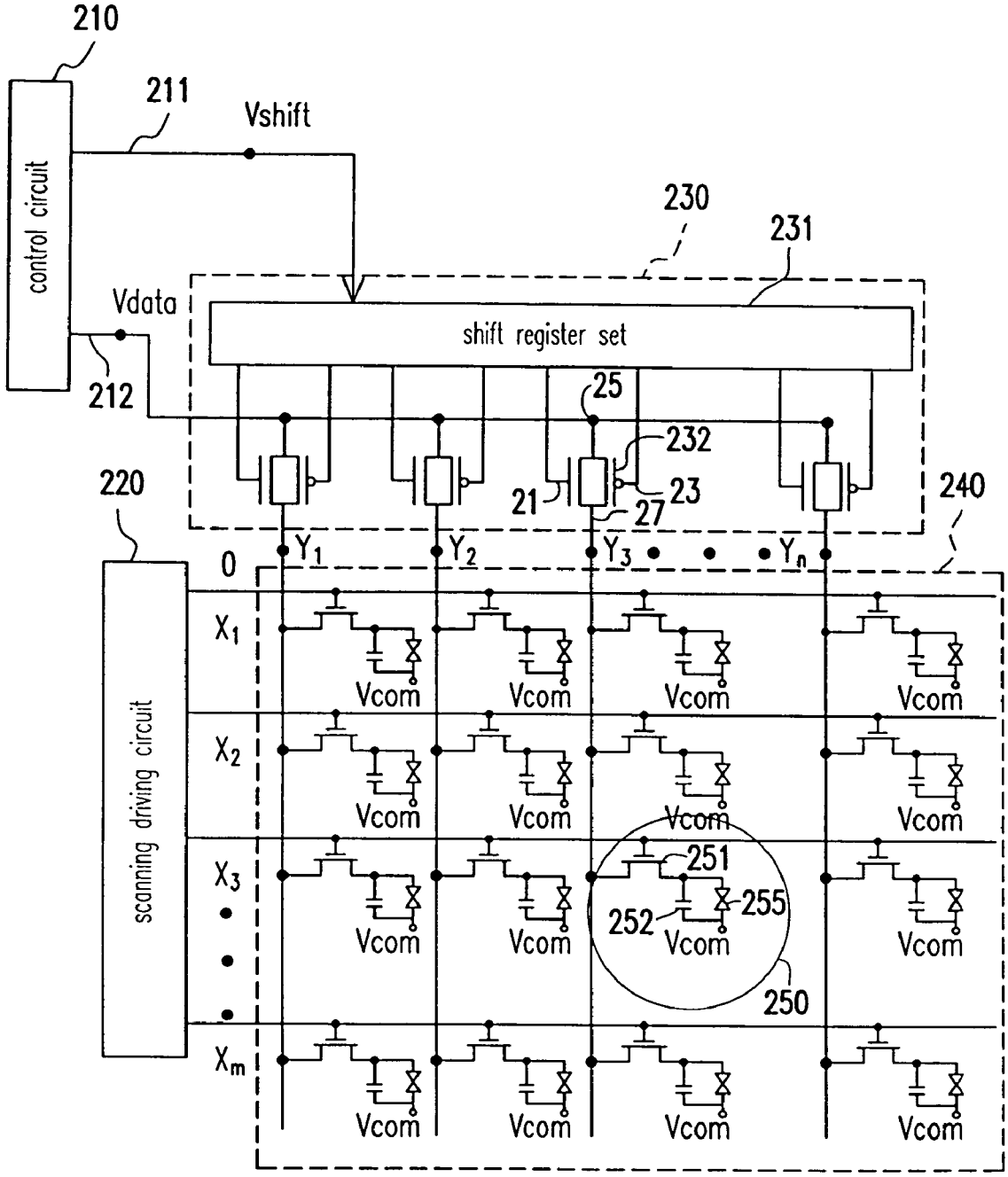
FIG. 2A (Related Art)
FIG. 2A is the internal circuit of a conventional LCD.
Figure 2B:
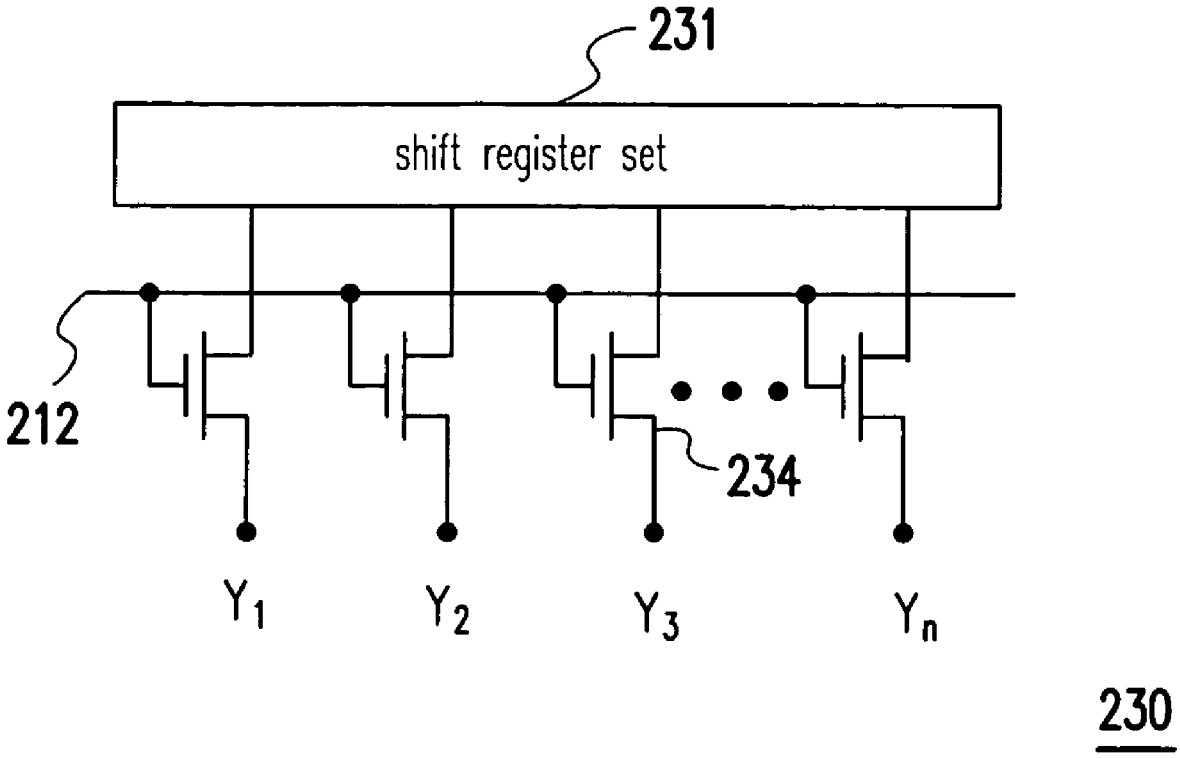
FIG. 2B (Related Art)
FIG. 2B is another data driving circuit of a conventional LCD.
Figure 3A:
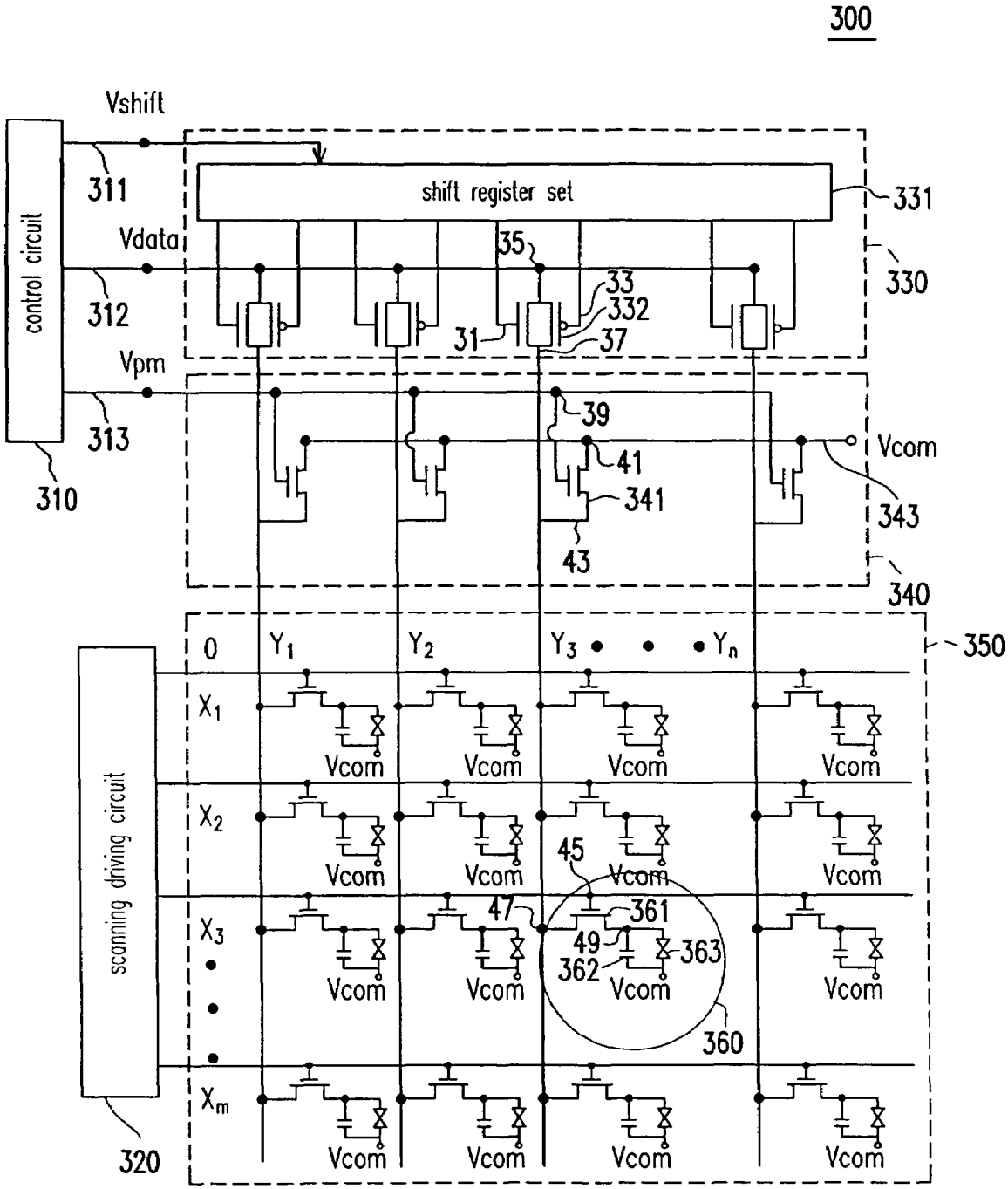
FIG. 3A is the internal circuit of an LCD using a MOS transistor as the switch in accordance with an exemplary embodiment of the present invention.

An exemplary internal circuit of an LCD using a MOS transistor as the switch is illustrated in FIG. 3A. Referring to FIG. 3A, an LCD 300 may include a control circuit 310 having a shift clock signal terminal 311 and a data signal terminal 312 respectively coupled to a data driving circuit 330. The LCD 300 may also include a partial display mode signal terminal 313 coupled to a partial display mode driving circuit 340. The data driving circuit 330 may be coupled to partial display mode driving circuit 340. The partial display mode driving circuit 340 may be coupled to an LCD panel 350. The LCD 300 may include a scanning driving circuit 320 coupled to LCD panel 350.

Referring to FIG. 3A, the data driving circuit 330 may include a shift register set 331 and a plurality of switch circuits such as, for example, a transmission gate 332. The shift register set 331 may be coupled to the shift clock signal terminal 311 of the control circuit 310 for receiving the shift clock signal Vshift. In addition, each of the transmission gates in data driving circuit 330, for example, transmission gate 332, may have a data signal input terminal 35 coupled to data signal terminal 312 of control circuit 310 for receiving a data signal Vdata. Each transmission gate, for example, transmission gate 332, may have a data signal output signal 37 for sending the data signal to partial display mode driving circuit 340. In addition, each of the transmission gates in the data driving circuit 330, for example, transmission gate 332, may have a first triggering terminal 31 and a second triggering terminal 33 coupled to the shift register set 331.

The data driving circuit 330 described above with respect to FIG. 3A may use the transmission gates as the switches, but the exemplary data driving circuit of the present invention can use one or more MOS transistor or other switch circuits to replace one or more transmission gates to achieve the same result.

Referring to FIG. 3A, partial display mode driving circuit 340 may include a plurality of switch circuits such as, for example, the MOS transistor 341. Each of the MOS transistors, for example, MOS transistor 341, may have a gate 39 coupled to partial display mode signal terminal 313 of control circuit 310 for receiving a partial display mode signal Vpm, a first source/drain 41 coupled to common voltage terminal 343 for receiving a common voltage Vcom, and a second source/drain 43 coupled to a data line, for example, data line $Y_3$.

Figure 3B:
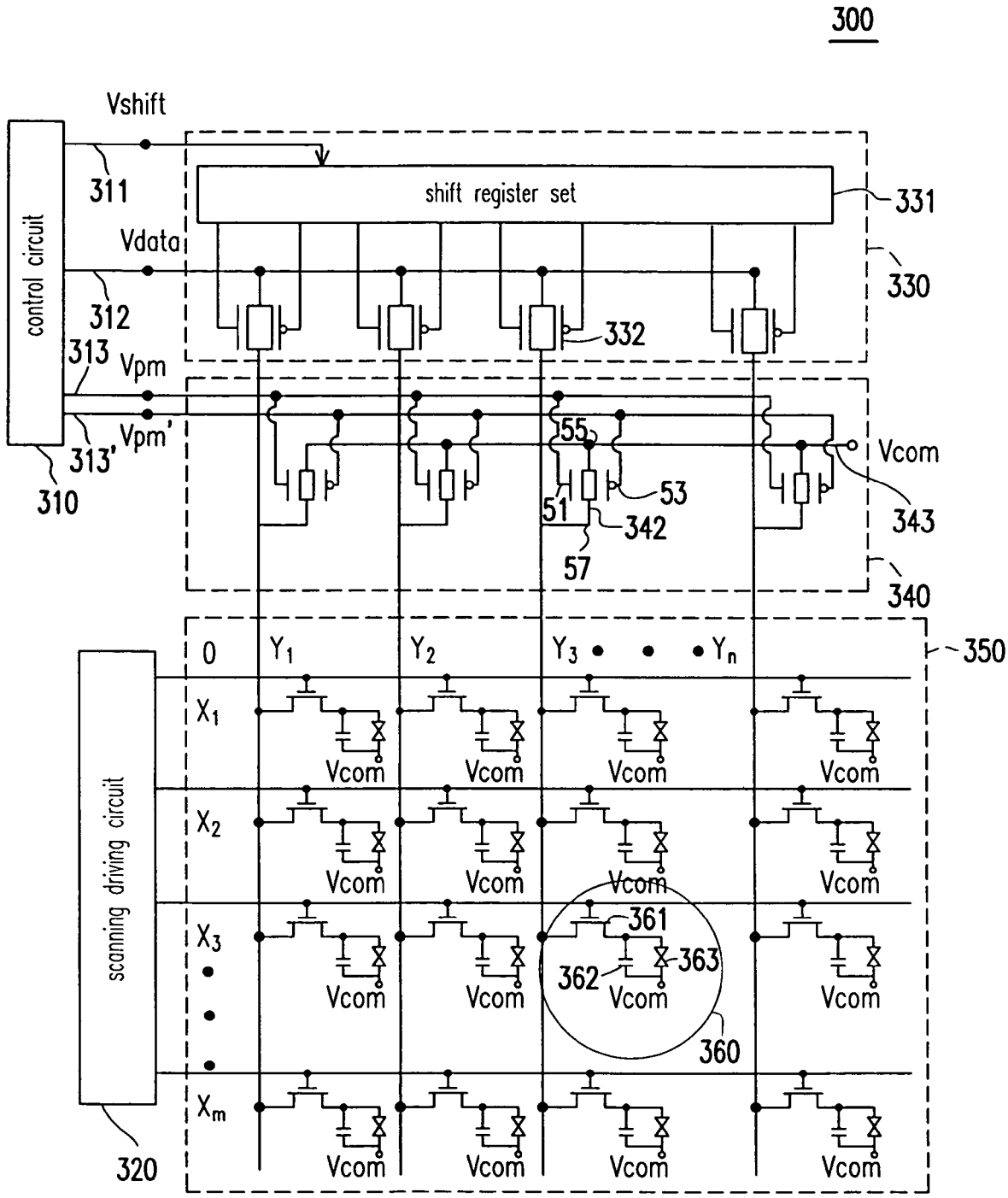
FIG. 3B is an internal circuit of an LCD using a transmission gate as the switch in accordance with an exemplary embodiment of the present invention.

According to various aspects, the present invention may provide another exemplary partial display mode driving circuit. FIG. 3B illustrates the internal circuit of an LCD that includes a transmission gate as the switch, in accordance with an exemplary embodiment of the present invention. In this embodiment, control circuit 310 includes first partial display mode signal terminal 313 and a second partial display mode signal terminal 313'. In addition, partial display mode driving circuit 340 may include a plurality of switches such as, for example, a transmission gate 342. Each of the transmission gates in partial display mode driving circuit 340, for example, transmission gate 342, may have a first triggering terminal 51, a second triggering terminal 53, a signal input terminal 55, and a signal output terminal 57. The first triggering terminal 51 and second triggering terminal 53 may be respectively coupled to first partial display mode signal terminal 313 and second partial display mode signal terminal 313'. The signal output terminal 55 may be coupled to common voltage terminal 343 for receiving the common voltage Vcom. The signal output terminal 57 may be coupled to a data line, for example, data line $Y_3$. The operation principles of the partial display mode driving circuit using the transmission gate and the partial display mode driving circuit using the MOS transistor are the same, and will be described later.

Referring to FIG. 3A, partial display mode driving circuit 340 has n data lines ($Y_1$-$Y_n$) and scanning driving circuit 320 has m scan lines ($X_1$-$X_m$). The data lines ($Y_1$-$Y_n$) and the scan lines ($X_1$-$X_m$) are arranged in an array manner on LCD panel 350. Each crossing of one of each data line ($Y_1$-$Y_n$) and one of each scan line ($X_1$-$X_m$) has a pixel cell such as pixel circuit 360. Each pixel circuit, like pixel circuit 360, includes TFT 361, capacitor 362, and pixel electrode 363. The gate 45 of TFT 361 is coupled to a scan lin, for example, scan line $X_3$. The source/drain 47 is coupled to a data line, for example, data line $Y_3$. The source/drain 47 is coupled to capacitor 362 and pixel electrode 363. The capacitor 362 and pixel electrode 363 are coupled to each other and have one end coupled to source/drain 49 of TFT 361 and the other end receiving the common voltage Vcom.

Referring to FIG. 3A, for simplicity purposes, pixel circuit 360 is taken as an example to describe the present invention. When LCD 300 has to show the image on the panel, scanning driving circuit 320 will send the scan signal via a scan line, for example, scan line $X_3$, to the gates of all TFTs coupled to the respective scan line for turning on two sources and drains of those TFTs. If pixel circuit 360 is disposed at the display area, control circuit 310 will send the shift clock signal Vshift to the shift register set to turn on the transmission gates in sequence. When the transmission gate is on, signal input terminal 35 will receive the data signal Vdata and signal output terminal 37 will output the data signal to the data line $Y_3$. At the same time, the partial display mode signal Vpm will turn off the switch circuits (e.g., MOS transistor 341). When the data signal Vdata is sent to TFT 361 via data line $Y_3$, the data signal Vdata will be conducted from source/drain 47 to source/drain 49 to charge capacitor 362 so that pixel electrode 363 on the panel lights up.

If pixel circuit 360 is at the non-display area, the control circuit will stop sending the shift clock signal Vshift to data driving circuit 330 and use the partial display mode signal Vpm to turn on MOS transistors 341 in the partial display mode driving circuit 340. When MOS transistor 341 is on, it will send the common voltage Vcom via a data line, for example, data line $Y_3$, to TFT 361. The common voltage Vcom will be conducted from source/drain 47 to source/drain 49. In the meantime, both ends of pixel electrode 363 and capacitor 362 are equipotential. Hence, capacitor 362 will not be charged, and pixel electrode 363 on the panel will become black or white, depending on which liquid crystal mode is being used.

Figure 4:
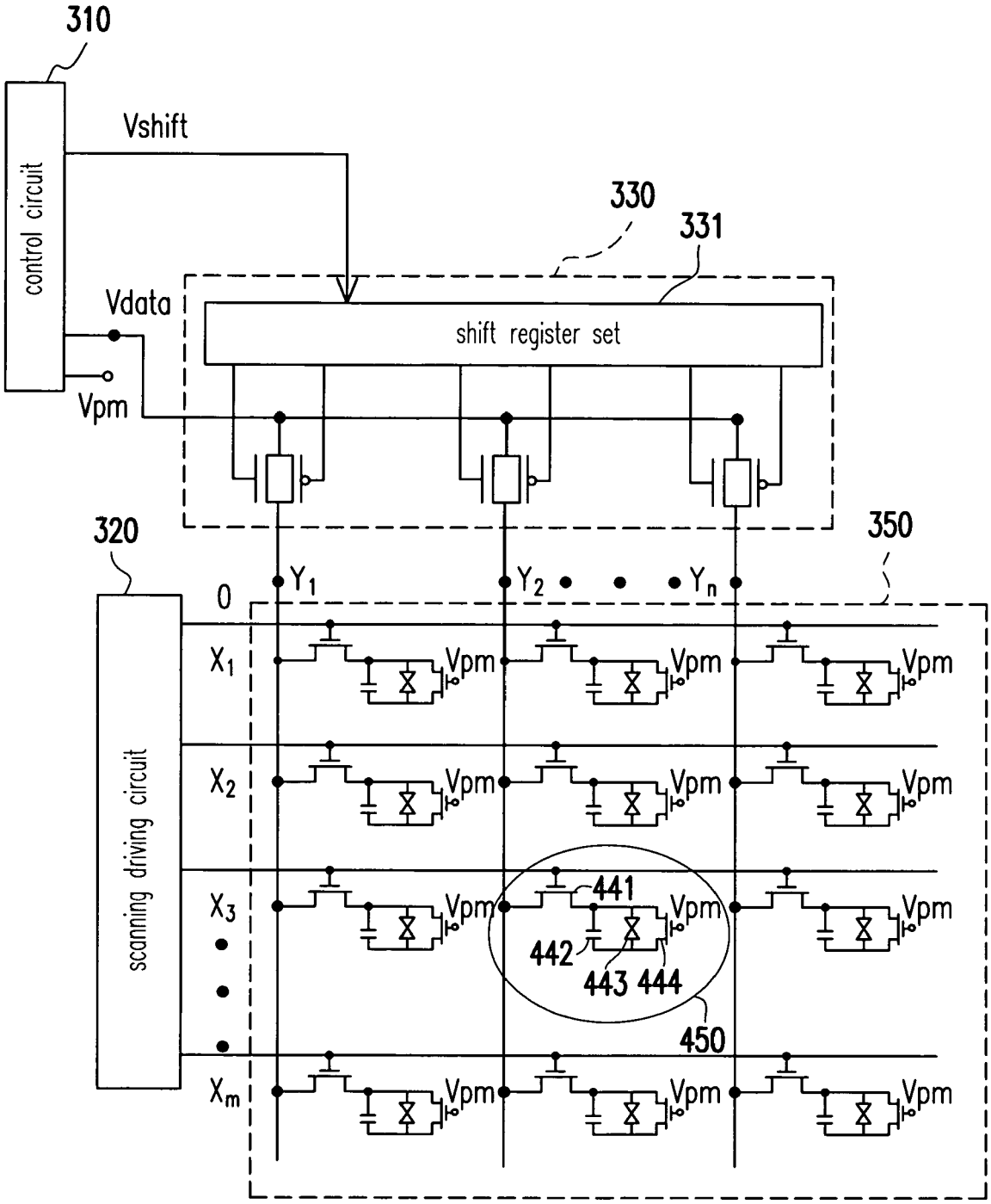
FIG. 4 is an internal circuit of an LCD in accordance with an exemplary embodiment of the present invention.

FIG. 4 illustrates a view of an internal circuit of an LCD in accordance with various aspects of the present invention. A difference between the above embodiment and this embodiment is that partial display mode driving circuit 340 is not used, and the switch transistor can be used to couple both ends of the pixel electrode. For simplicity purpose, a pixel circuit 450 is taken as an example to describe the present invention. The pixel circuit 450 includes a TFT 441, a capacitor 442, a pixel electrode 443, and a switch transistor 444. The two sources/drains (unnumbered) of switch transistor 444 are cross-coupled to both ends of pixel electrode 443. The gate receives the partial display mode signal Vpm to determine whether to turn on switch transistor 444. If pixel circuit 450 is at the display area, the operation is the same as that of the above embodiment. If the pixel circuit 360 is at the non-display area, control circuit 310 will stop sending the shift clock signal Vshift, and the partial display mode signal Vpm will turn on switch transistor 444 so that both ends of pixel electrode 443 are substantially short-circuited and there is no light on the display.

Although the above embodiment is disclosed to provide another circuit to make both ends of the pixel electrode equipotential, not every pixel electrode has to be coupled to one transistor circuit. One skilled in the art can make one or more pixel electrodes coupled to the transistor circuits as needed.

Figure 5:
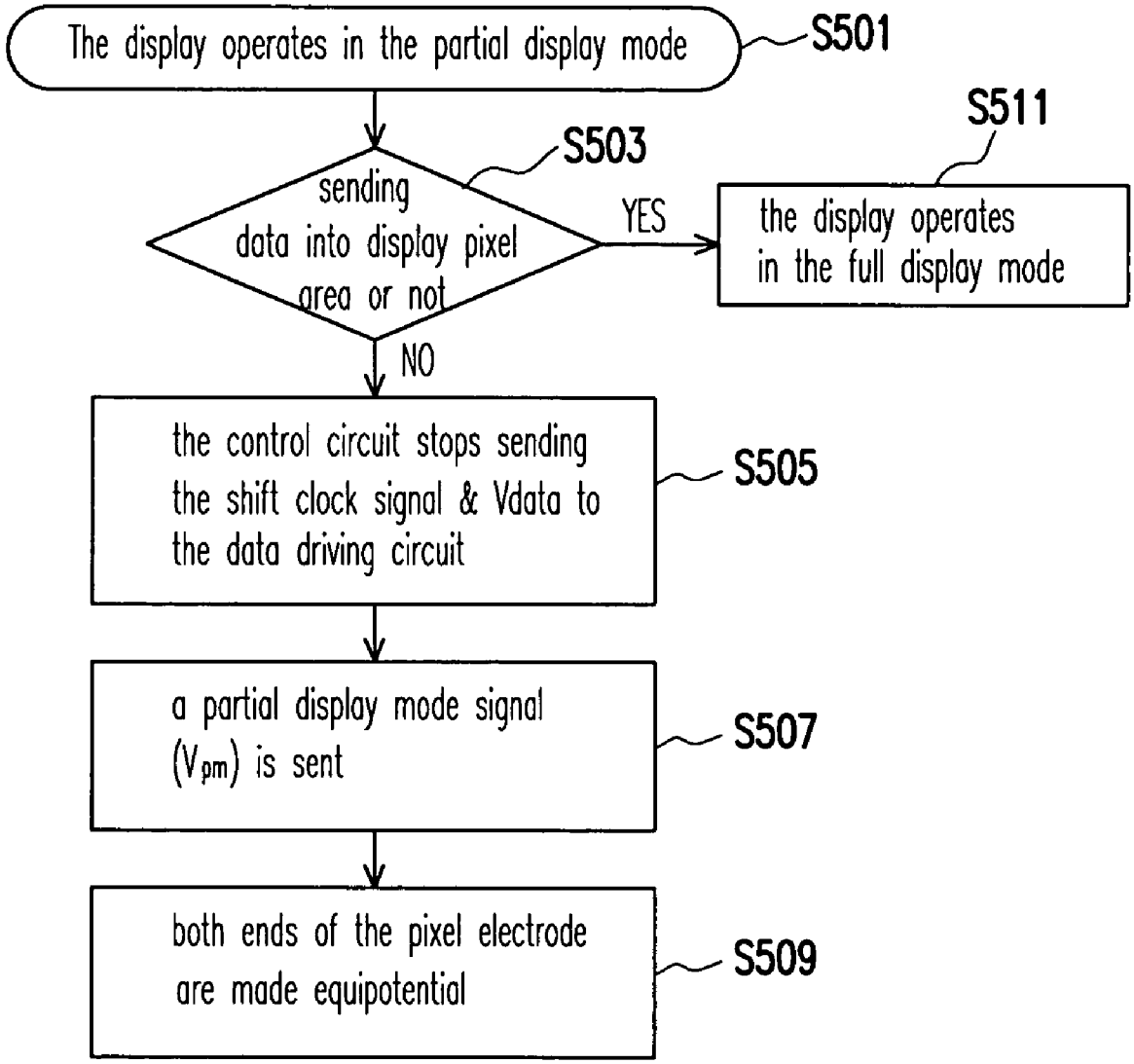
FIG. 5 is a flowchart illustrating the operation of the LCD in the partial display mode according to an exemplary embodiment of the present invention.

FIG. 5 illustrates a flowchart of an operation of the LCD in the partial display mode according to an embodiment of the present invention. Based on the above two embodiments, one can deduce a method for operating the display in the partial display mode. First, operation begins in step S501 when the display operates in the partial display mode. Then in step S503, it is determined whether display data is to be sent into the display pixel area or not. If it is determined that data is to be sent to the display pixel area in step S503, control proceeds to step S511, where the display operates in the full display mode.

If it is determined that data is not to be sent to the display pixel area in step S503, control proceeds to step S505 where the control circuit stops sending the shift clock signal and the data signal Vdata to the data driving circuit. Control proceeds to step S507, where a partial display mode signal (Vpm) is sent to the display. Then, in step S509, the display therefore makes both ends of the pixel electrode equipotential.

In light of the above, when the LCD works in the partial display mode, the present invention makes both ends of the pixel electrode equipotential. Hence, the operation of data driving circuit is not complicated and thus can reduce power consumption.

The above description provides an exemplary description of various aspects of the present invention. Various modifications, alternate construction, and equivalents may be made by those skilled in the art without changing the scope or spirit of the invention. Accordingly, the above description and illustrations should not be construed as limiting the scope of the invention which is defined by the following claims.

What is claimed is:

1. A display circuit for a liquid crystal display panel, comprising:

a data driving circuit having a plurality of data lines coupled to said liquid crystal display panel, wherein when said liquid crystal display panel is scanned to a display area, said data driving circuit sends out a data signal to said liquid crystal display panel via one of said plurality of data lines based on a shift clock signal;

a partial display mode driving circuit having a plurality of common voltage output terminals corresponding to and being coupled to said plurality of data lines, wherein when said liquid crystal display panel is scanned to a non-display area, said partial display mode driving circuit receives a partial display mode signal and sends a common voltage to said liquid crystal display panel via said plurality of data lines; and a control circuit coupled to said data driving circuit and said partial display mode driving circuit, said control circuit sending out said shift clock signal to said data driving circuit and said partial display mode signal to said partial display mode driving circuit, wherein when said liquid crystal display panel is scanned to said non-display area, said control circuit stops sending out said shift clock signal and starts to send said partial display mode signal to enable said partial display mode driving circuit.

2. The display circuit of claim 1, wherein said partial display mode driving circuit includes a plurality of switches respectively coupled to one of said plurality of data lines, and wherein said partial display mode signal determines whether or not to turn on said plurality of switches.

3. The display circuit of claim 2, wherein each of said plurality of switches includes a transmission gate having a first triggering terminal, a second triggering terminal, a common voltage input terminal, and a common voltage output terminal, said first triggering terminal and said second triggering terminal being coupled to said control circuit for receiving said partial display mode signal to determine whether or not to turn on said transmission gate, said common voltage input terminal receiving said common voltage, said common voltage output terminal being coupled to one of said plurality of data lines.

4. The display circuit of claim 2, wherein each of said plurality of switches includes a MOS transistor having a gate, a first source/drain, and a second source/drain, said gate being coupled to said control circuit for receiving said partial display mode signal to determine whether or not to turn on said transmission gate, said first source/drain receiving said common voltage, and said second source/drain being coupled to one of said plurality of data lines.

5. A display circuit for a liquid crystal display panel, comprising:

a data driving circuit having a plurality of data lines coupled to said liquid crystal display panel, wherein when said liquid crystal display panel is scanned to a display area, said data driving circuit sends out a data signal to said liquid crystal display panel via one of said plurality of data lines based on a shift clock signal;

a plurality of switches, a partial display mode signal determining whether or not to turn on said plurality of switches, wherein when said liquid crystal display panel is scanned to a non-display area, said partial display mode signal turns on a portion of said plurality of switches corresponding to a portion of said plurality of data lines in said non-display area; and a control circuit coupled to said data driving circuit, wherein when said liquid crystal display panel is scanned to a display area, said control circuit sends out said shift clock signal to said data driving circuit and, when said liquid crystal display panel is scanned to said non-display area, said control circuit stopping sends out said shift clock signal and starts to send said partial display mode signal to enable said plurality of switches.

6. The display circuit of claim 5, wherein each of said plurality of switches includes a MOS transistor having a gate for receiving said partial display mode signal.

7. The display circuit of claim 5, further comprising a plurality of pixel circuits arranged in an array on said liquid crystal display panel, wherein each of said plurality of pixel circuits includes a pixel electrode.

8. The display circuit of claim 7, wherein both ends of each of said pixel electrode are respectively coupled to two sources/drains of one of said plurality of MOS transistors.

9. The display circuit of claim 7, wherein both ends of one of said pixel electrode are respectively coupled to two sources/drains of one of said plurality of MOS transistors.

10. A display method for a display having a plurality of pixel electrodes and a plurality of data lines, said display including a data driving circuit, said data driving circuit being controlled by a shift clock signal, said method comprising:

determining whether the pixel electrodes are in a display area; and substantially short-circuiting both ends of said plurality of pixel electrodes to make both ends of said plurality of pixel electrodes equipotential when the pixel electrodes are not in said display area, wherein said step of making said both ends of said plurality of pixel electrodes equipotential includes:

stopping sending of said shift clock signal to said data driving circuit; and sending a common voltage via said plurality of data lines to said plurality of pixel electrodes.

11. A display method for a display having a plurality of pixel electrodes and a plurality of data lines, said display including a data driving circuit, said data driving circuit being controlled by a shift clock signal, said method comprising:

determining whether the pixel electrodes are in a display area; and substantially short-circuiting both ends of said plurality of pixel electrodes to make both ends of said plurality of pixel electrodes equipotential when the pixel electrodes are not in said display area, wherein said step of making said both ends of said plurality of pixel electrodes equipotential includes:

stopping sending of said shift clock signal to said data driving circuit; and sending a partial display mode signal to substantially short-circuit said both ends of said plurality of pixel electrodes.

* * * * *